US009098051B2

(12) United States Patent
Wakamatsu et al.

(10) Patent No.: US 9,098,051 B2
(45) Date of Patent: Aug. 4, 2015

(54) COLLECTION DEVICE AND IMAGE FORMING APPARATUS

(71) Applicant: Brother Kogyo Kabushiki Kaisha, Nagoya-shi, Aichi-ken (JP)

(72) Inventors: Mayu Wakamatsu, Tsushima (JP); Hiroshige Hiramatsu, Inuyama (JP); Yoshiyuki Okazaki, Nagoya (JP); Masamitsu Takahashi, Nagoya (JP); Takamasa Tsukada, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/635,153

(22) Filed: Mar. 2, 2015

(65) Prior Publication Data

US 2015/0177675 A1 Jun. 25, 2015

Related U.S. Application Data

(63) Continuation of application No. 13/779,825, filed on Feb. 28, 2013.

(30) Foreign Application Priority Data

Feb. 29, 2012 (JP) ..... 2012-044603

(51) Int. Cl.
*G03G 21/00* (2006.01)
*G03G 21/10* (2006.01)

(52) U.S. Cl.
CPC ..... *G03G 21/105* (2013.01)

(58) Field of Classification Search
CPC ..... G03G 15/55; G03G 21/10; G03G 21/12; G03G 21/105
USPC ..... 399/34, 35, 99, 123, 343, 358
See application file for complete search history.

(56) References Cited

U.S. PATENT DOCUMENTS 5,502,549 A 3/1996 Hart et al.
5,617,195 A * 4/1997 Torimaru et al. ..... 399/27

(Continued)

FOREIGN PATENT DOCUMENTS

JP 04-152377 A 5/1992
JP 2006-085112 A 3/2006

(Continued)

OTHER PUBLICATIONS

Mar. 13, 2015—(US) Notice of Allowance—U.S. Appl. No. 13/779,825.

*Primary Examiner* — Francis Gray
(74) *Attorney, Agent, or Firm* — Banner & Witcoff, Ltd.

(57) ABSTRACT

A collection device including: an accommodation part configured to accommodate therein collected adhering substance; and a detection part configured to detect an amount of the adhering substance in the accommodation part and including, a moving member configured to move from a first position to a second position, the accommodation part being capable of accommodating therein the adhering substance when the moving member is arranged at the first position and being full of the adhering substance when the moving member is in the second position, and a restraining member configured to restrain the moving member from moving from the first position to the second position when the moving member is arranged at the first position, and restrain the moving member from moving from the second position to the first position when the moving member is arranged at the second position.

7 Claims, 11 Drawing Sheets

(56) References Cited

U.S. PATENT DOCUMENTS

| | | | | |
|---|---|---|---|---|
| 6,782,235 | B2 * | 8/2004 | Serizawa et al. | 399/360 |
| 7,373,092 | B2 | 5/2008 | Tawada | |
| 7,983,609 | B2 | 7/2011 | Yokota | |
| 2006/0039710 | A1 | 2/2006 | Tawada | |
| 2008/0124157 | A1 * | 5/2008 | Nakano et al. | 399/358 |
| 2009/0220257 | A1 * | 9/2009 | Tsusaka et al. | 399/35 |
| 2010/0247119 | A1 * | 9/2010 | Kawahara | 399/35 |

FOREIGN PATENT DOCUMENTS

| | | | |
|---|---|---|---|
| JP | 4085571 | B2 | 5/2008 |
| JP | 2012-042790 | A | 3/2012 |

* cited by examiner

COLLECTION DEVICE AND IMAGE FORMING APPARATUS

CROSS-REFERENCE TO RELATED APPLICATIONS

This application claims priority from Japanese Patent Application No. 2012-044603 filed on Feb. 29, 2012, the entire contents of which are incorporated herein by reference.

TECHNICAL FIELD

Aspects of the invention relate to a collection device, and more particularly, to a collection device for collecting adhering substance on an image carrier that is provided in an image forming apparatus of an electrophotographic type, and an image forming apparatus including the collection device.

BACKGROUND

As an image forming apparatus of an electrophotographic type, an image forming apparatus has been known which has an image carrier carrying thereon a developer image, a transfer device transferring the developer image from the image carrier to a medium to be transferred and a collection device collecting transfer residual developer remaining on the image carrier after the transfer.

As the collection device that is provided in the image forming apparatus, a toner container has been suggested which has a cleaner collecting residual toner on the image carrier, an auger conveying the toner collected by the cleaner and a sensing bar fixed to the auger (for example, see JP-A-H04-152377).

In the toner container, the auger is spirally formed by an elastic material. Also, the image forming apparatus is provided with a detection unit that faces the sensing bar.

A compressive deformation of the auger due to the toner collected in the toner container brings the sensing bar into contact with the detection unit. Thereby, the detection unit detects that the toner container is full of the toner.

According to the toner container disclosed in JP-A-H04-152377, the auger is compressively deformed due to the toner collected in the toner container, so that the sensing bar is moved.

Therefore, when the residual toner is accumulated so as to concentrate at a periphery of the auger, the auger is compressively deformed even though the toner container is not full. As a result, the detection unit may erroneously detect that the toner container is full of the toner.

SUMMARY

Accordingly, an object of the invention is to provide a collection device capable of stably detecting that an accommodation unit is full of adhering substance that was adhered to an image carrier, and an image forming apparatus including the collection device.

According to an aspect of the invention, there is provided a collection device configured to collect adhering substance adhered on an image carrier configured to carry a developer image thereon. The collection device includes: an accommodation part and a detection part. The accommodation part is configured to accommodate therein the collected adhering substance. The detection part is configured to detect an amount of the adhering substance in the accommodation part. The detection part includes a moving member and a restraining member. The moving member is configured to move from a first position to a second position that is different from the first position when a pressing force from the adhering substance exceeds a predetermined pressure. The accommodation part is capable of accommodating therein the adhering substance when the moving member is arranged at the first position and is full of the adhering substance when the moving member is in the second position. The restraining member is configured to restrain the moving member from moving from the first position to the second position when the moving member is arranged at the first position, and restrain the moving member from moving from the second position to the first position when the moving member is arranged at the second position.

According to the above-described configuration, when the accommodation part can accommodate therein the adhering substance, the moving member is arranged at the first position and is restrained from moving from the first position to the second position by the restraining member.

When the accommodation part is full of the adhering substance and thus the pressing force originating from the adhering substance exceeds a predetermined pressure, the moving member is moved against the restraining of the restraining member from the first position to the second position and is then restrained from moving from the second position to the first position by the restraining member.

Thereby, when the accommodation part can accommodate therein the adhering substance, it is possible to surely detect that the accommodation part can accommodate therein the adhering substance because the moving member is restrained at the first position.

Also, after the accommodation part is full of the adhering substance and thus the moving member is moved to the second position, it is possible to surely detect that the accommodation part is full of the adhering substance because the moving member is restrained at the second position.

As a result, it is possible to stably detect that the accommodation part is full of the adhering substance.

According to another aspect of the present invention, there is provided an image forming apparatus including an image carrier configured to carry thereon a developer image. The image forming apparatus includes: the above-described collection device, a detection unit and a determination unit. The detection unit is configured to detect the moving of the moving member from the first position to the second position. The determination unit is configured to detect that the accommodation part is full of the adhering substance when the detection unit detects the moving of the moving member from the first position to the second position.

According to the above-described configuration, when the accommodation part can accommodate therein the adhering substance, the moving member is arranged at the first position and is restrained from moving from the first position to the second position by the restraining member.

When the accommodation part is full of the adhering substance, the moving member is moved against the restraining of the restraining member from the first position to the second position.

At this time, the detection unit detects the moving of the moving member from the first position to the second position and the determination unit determines that the accommodation part is full based on the detection.

Thereby, when the accommodation part can accommodate therein the adhering substance, it is possible to surely detect that the accommodation part can accommodate therein the adhering substance because the moving member is restrained at the first position.

Also, after the accommodation part is full of the adhering substance and the moving member is thus moved to the second position, it is possible to surely detect that the accommodation part is full of the adhering substance because the moving member is restrained at the second position.

As a result, it is possible to stably detect that the accommodation part is full of the adhering substance.

According to the collection device and the image forming apparatus of the invention, it is possible to stably detect that the accommodation part is full of the adhering substance.

DETAILED DESCRIPTION

1. Overall Configuration of Printer

Figure 1:
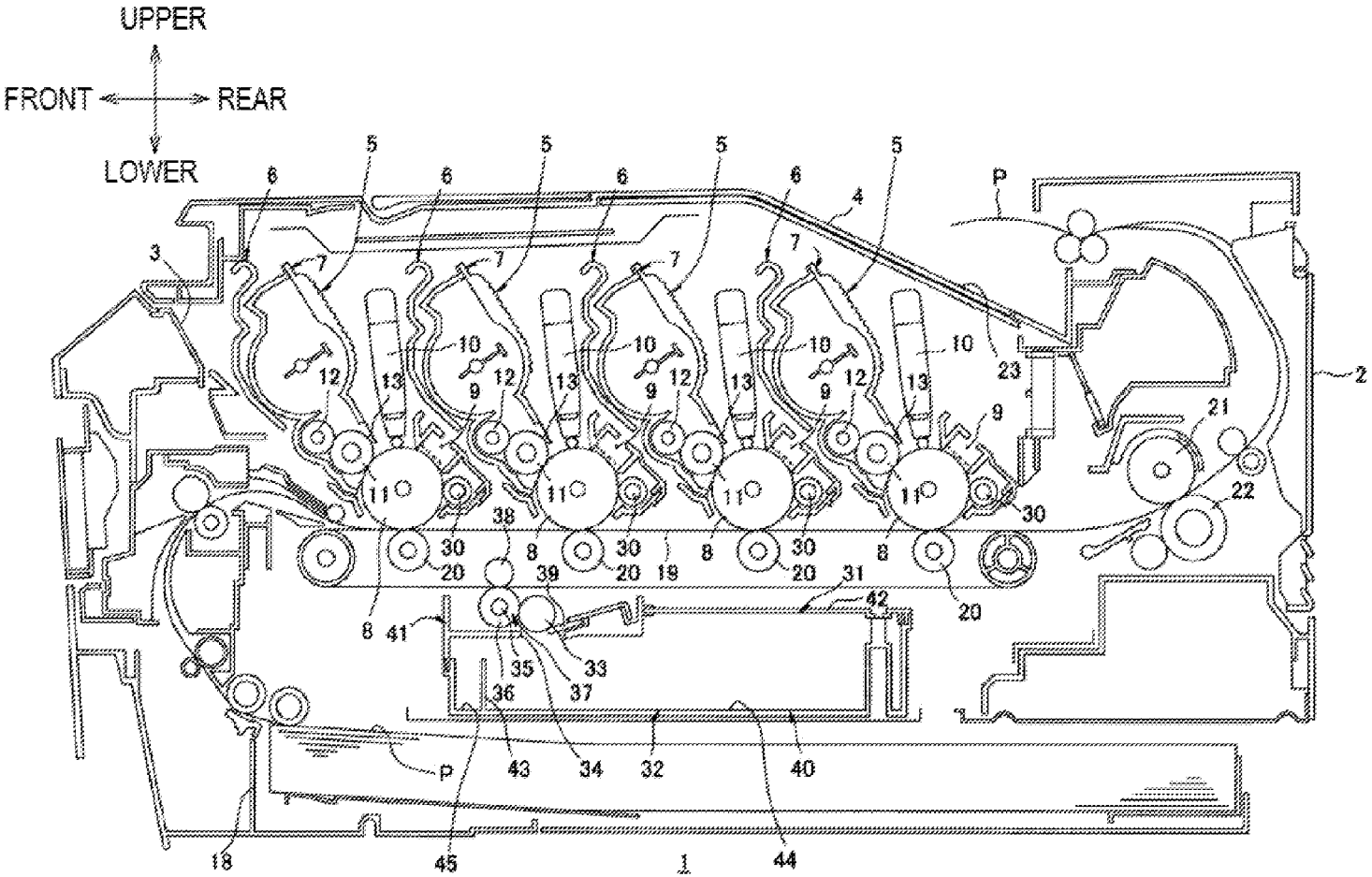
FIG. 1 is a central sectional view of a printer that is an illustrative embodiment of the image forming apparatus of the invention.

As shown in FIG. 1, a printer 1 that is an example of the image forming apparatus is a direct tandem-type color printer of a horizontal arrangement type.

Meanwhile, in the following descriptions, the directions are described on the basis of a state where the printer 1 is horizontally stored. That is, the left side of FIG. 1 is referred to as the front side and the right side of FIG. 1 is referred to as the rear side. Also, the left side and the right side are described on the basis of a state where the printer 1 is seen from the front. That is, the front side of FIG. 1 is the right side and the inner side of FIG. 1 is the left side.

The printer 1 has a body casing 2 having a substantially box shape. A top cover 4 that opens and closes a body opening 3 is provided to an upper end portion of the body casing 2 so that it can be rotated about a rear end portion thereof serving as a support point. The top cover 4 has LED units 10 that are arranged to face photosensitive drums 8 (which will be described later) at the upper of the photosensitive drums. The printer 1 has four process cartridges 5.

All process cartridges 5 are detachably provided in the body casing 2 and are arranged in parallel with each other at an interval in the front-rear direction. Also, the four process cartridges 5 correspond to four colors (black, yellow, magenta, cyan), respectively.

The process cartridge 5 has a drum cartridge 6 and a developing cartridge 7 that is detachably mounted to the drum cartridge 6.

The drum cartridge 6 has a photosensitive drum 8 that is an example of the image carrier.

The photosensitive drum 8 has a substantially cylindrical shape that is long in the left-right direction and is rotatably provided to the drum cartridge 6.

Also, the drum cartridge 6 has a scorotron-type charger 9 that is arranged to face the photosensitive drum 8 at the rear-upper side of the photosensitive drum and a drum cleaning roller 30 that is arranged to face the photosensitive drum 8 at the rear of the photosensitive drum, around the photosensitive drum 8.

The developing cartridge 7 has a developing roller 11.

The developing roller 11 extends in the left-right direction, is provided at a rear end portion of the developing cartridge 7 so that it is exposed from the rear and contacts the photosensitive drum 8 from a front-upper side of the photosensitive drum.

Also, the developing cartridge 7 has a supply roller 12 that supplies toner to the developing roller 11 and a layer thickness regulation blade 13 that regulates a thickness of the toner supplied to the developing roller 11.

Also, the toner that is an example of the developer is accommodated above the developing roller 11 and the supply roller 12 in the developing cartridge 7.

The toner in the developing cartridge 7 is positively friction-charged between the supply roller 12 and the developing roller 11 and is carried on a surface of the developing roller 11 as a thin layer having a predetermined thickness by the layer thickness regulation blade 13.

In the meantime, a surface of the photosensitive drum 8 is uniformly charged by the scorotron-type charger 9 and is exposed on the basis of predetermined image data by the LED unit 10. Thereby, an electrostatic latent image based on the image data is formed on the surface of the photosensitive drum 8. Then, the toner carried on the developing roller 11 is supplied to the electrostatic latent image on the surface of the photosensitive drum 8, so that a toner image (developer image) is carried on the surface of the photosensitive drum 8.

A sheet P is accommodated in a sheet feeding tray 18 that is provided at a bottom part in the body casing 2, is conveyed to U-turn towards the rear-upper side by a variety of rollers and is fed one by one between the photosensitive drum 8 and a conveyance belt 19, which contacts the photosensitive drum 8 from a lower side of photosensitive drum, at a predetermined timing. The sheet P is conveyed from the front towards the rear between all the photosensitive drums 8 and all the transfer rollers 20 so that it contacts the photosensitive drums 8.

At this time, the toner that is not transferred to the sheet P may remain on a circumferential surface of the photosensitive drum 8.

The transfer residual toner remaining on the circumferential surface of the photosensitive drum 8 faces the drum cleaning roller 30 as the photosensitive drum 8 rotates. Then, the transfer residual toner is electrostatically held on the circumferential surface of the drum cleaning roller 30 by a drum cleaning bias.

The sheet P having the toner image transferred thereto is heated and pressed when it passes between a heating roller 21 and a pressing roller 22. At this time, the toner image is heat-fixed on the sheet P.

After that, the sheet P is conveyed to U-turn towards the front-upper side and is then discharged onto a sheet discharge tray 23 that is provided to the top cover 4.

2. Configuration of Belt Cleaning Unit

In the body casing 2, a belt cleaning unit 31 that is an example of the collection device is provided below the conveyance belt 19 and above the sheet feeding tray 18.

Figure 2:
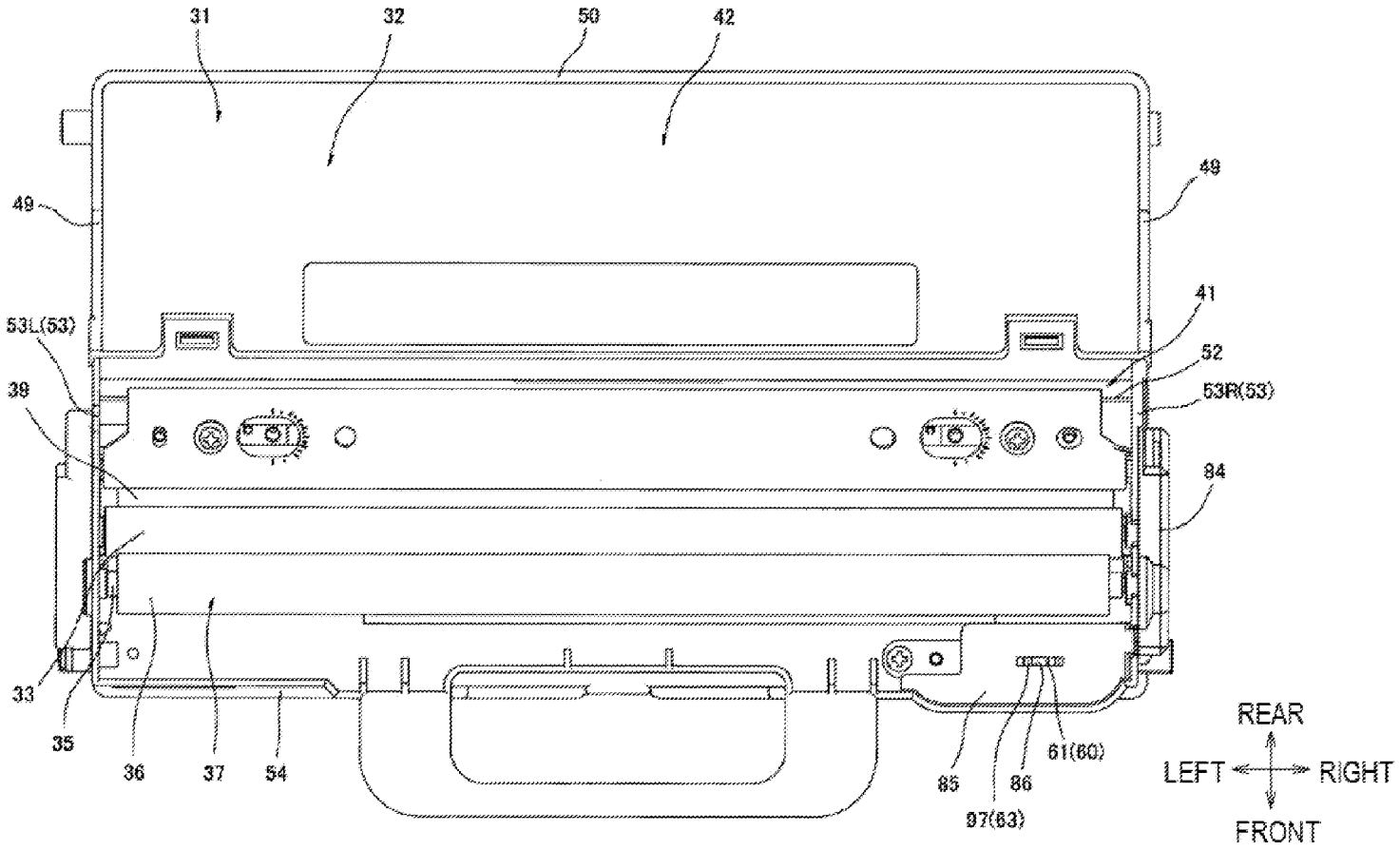
FIG. 2 is a plan view of a belt cleaning unit shown in FIG. 1.
Figure 3:
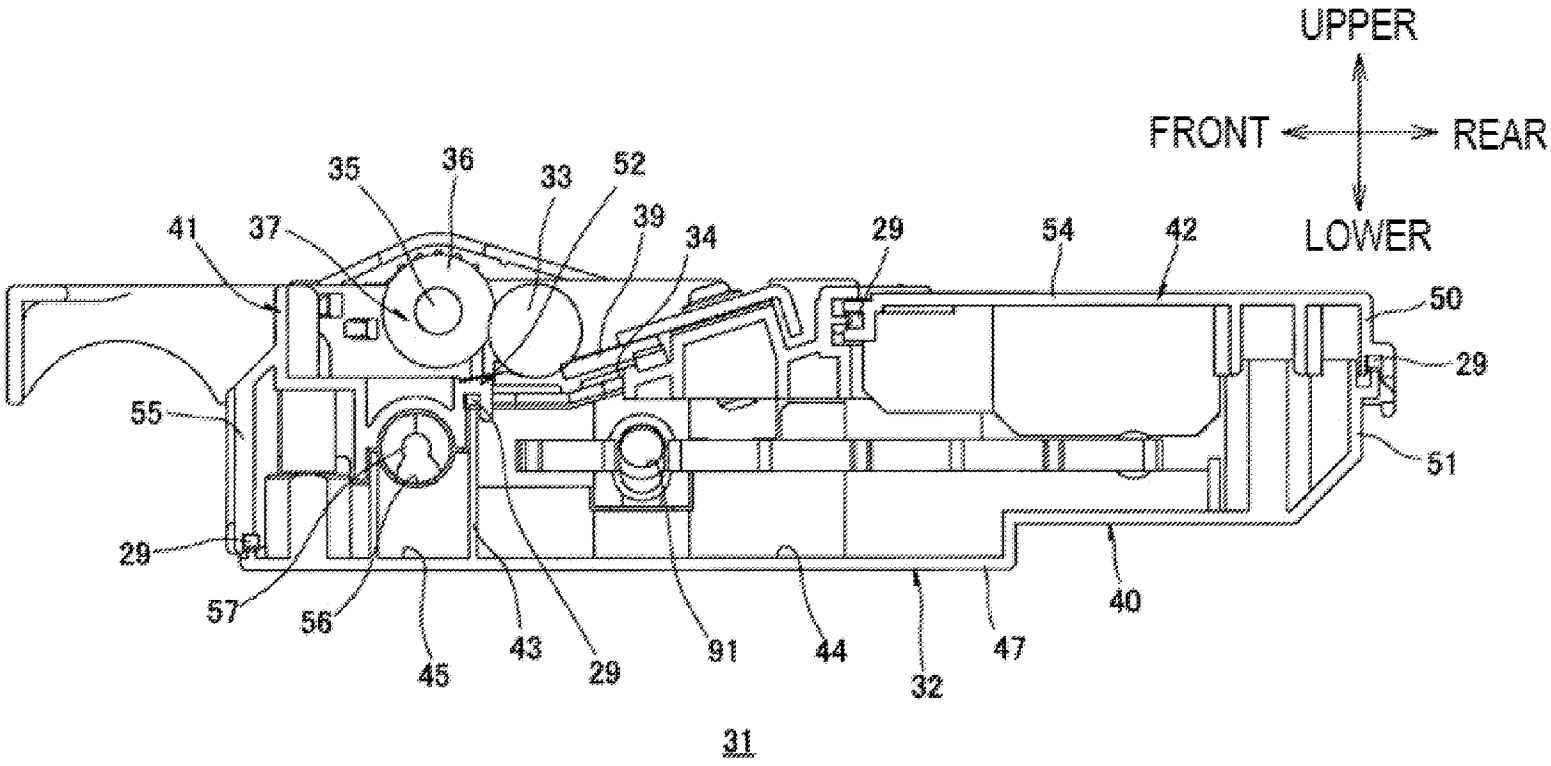
FIG. 3 is a central sectional view of the belt cleaning unit shown in FIG. 2.
Figure 4:
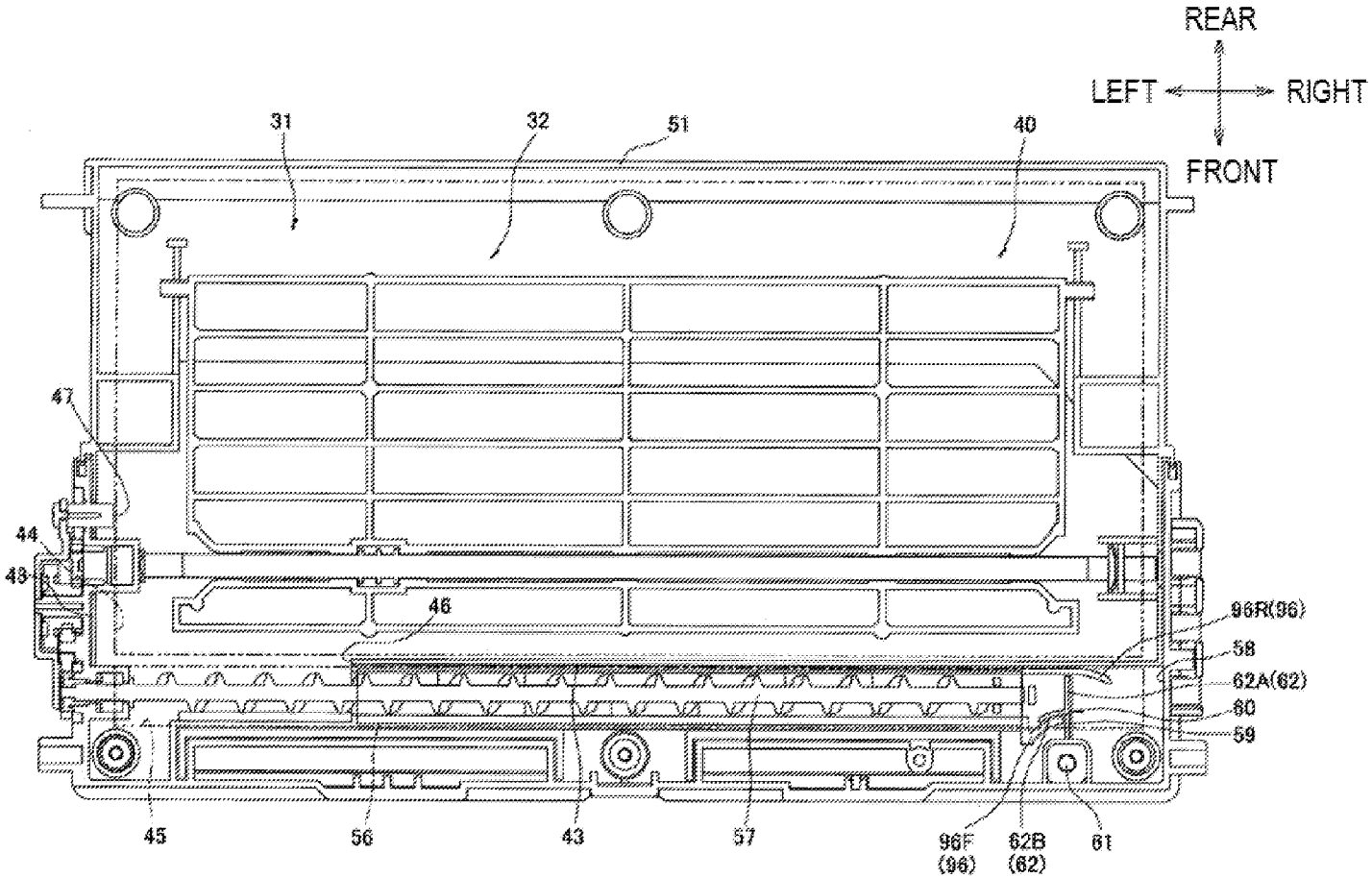
FIG. 4 is a plan sectional view of the belt cleaning unit shown in FIG. 2.

As shown in FIGS. 2 to 4, the belt cleaning unit 31 has an accommodation housing 32 that is an example of the accommodation unit, a belt cleaning roller 37, a collection roller 33 that is an example of the collection member and a scraping blade 39.

(1) Accommodation Housing

The Accommodation Housing 32 has a Reservoir Frame 40, a Support Frame 41 and a cover frame 42.

The reservoir frame 40 configures a lower side of the accommodation housing 32 and has a frame shape that has an open upper side and a substantially rectangular bottom surface, when seen from a plan view. The reservoir frame 40 has a reservoir frame bottom wall 47, a pair of left and right reservoir frame sidewalls 48, a reservoir frame rear wall 51 and a partition wall 43.

The reservoir frame bottom wall 47 is provided at a lower end portion of the reservoir frame 40 and has a substantially rectangular flat plate shape, when seen from a plan view.

The pair of reservoir frame sidewalls 48 has a substantially flat plate shape that extends upwards from both left and right end portions of the reservoir frame bottom wall 47 and also extends in the front-rear direction, respectively.

The reservoir frame rear wall 51 has a substantially flat plate shape that extends upwards continuously from a rear end portion of the reservoir frame bottom wall 47 and also extends in the left-right direction. In the meantime, both left and right end portions of the reservoir frame rear wall 51 continue to respective rear end portions of the pair of reservoir frame sidewalls 48.

Figure 5:
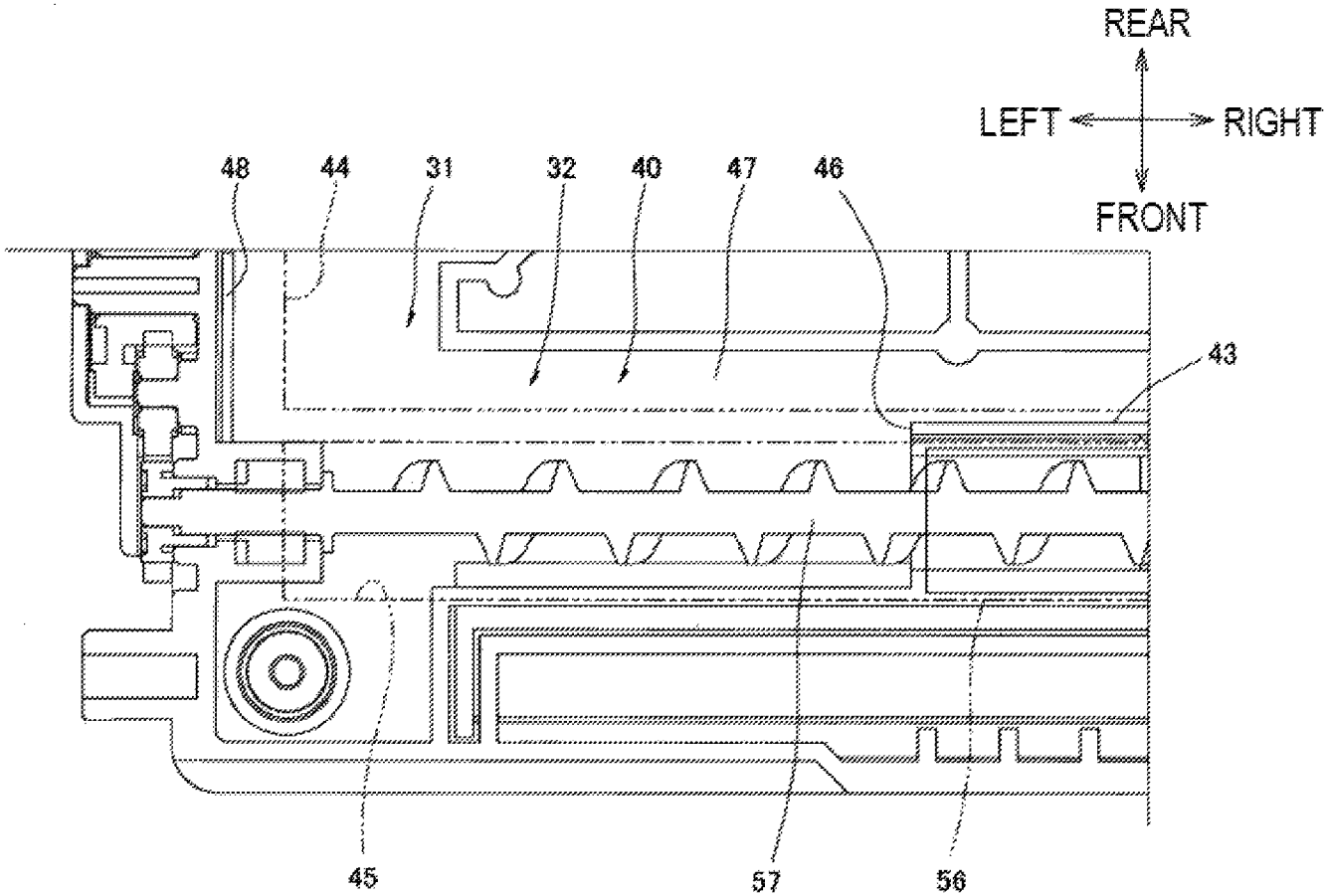
FIG. 5 is a plan sectional view of a left front end portion of the belt cleaning unit shown in FIG. 2.

The partition wall 43 has a substantially flat plate shape that extends upwards from a portion of the reservoir frame bottom wall 47 in the front-rear direction and also extends in the left-right direction. In the meantime, a right end portion of the partition wall 43 is continuous with the right reservoir frame sidewall 48 and a left end portion of the partition wall 43 is arranged at the left of the left reservoir frame sidewall 47 at an interval so as to form a communication hole 46 communicating a first accommodation part 44 and a second accommodation part 45, which will be described later (refer to FIGS. 4 and 5).

The support frame 41 is provided at the upper side of a front half part of the reservoir frame 40. The support frame 41 has a frame shape that has open rear and lower sides and also has a substantially rectangular bottom, when seen from a plan view. The support frame 41 has a pair of left and right support frame sidewalls 53, a support frame upper wall 52 and a support frame front wall 55. Meanwhile, in the following descriptions, when describing the left-right direction of the support frame sidewalls 53, the left support frame sidewall 53 is referred to as a left support frame sidewall 53L and the right support frame sidewall 53 is referred to as a right support frame sidewall 53R.

The pair of support frame sidewalls 53 is arranged to face each other at an interval in the left-right direction and has a substantially rectangular flat plate shape, respectively, when seen from a side extending in the upper-lower and front-rear directions.

The support frame upper wall 52 is provided at a substantial center of the support frame 41 in the upper-lower direction. The support frame upper wall 52 has a substantially rectangular flat plate shape, when seen from a plan view extending in the front-rear direction and is built between the pair of support frame sidewalls 53. The support frame upper wall 52 is formed with a collection opening 34.

The collection opening 34 is a through-hole that extends in the left-right direction at a substantial center of the support frame upper wall 52 in the front-rear direction.

The support frame front wall 55 has a substantially flat plate shape that extends in the upper-lower direction and is built between front end portions of the pair of support frame sidewalls 53.

The support frame 41 covers a front half part of the reservoir frame 40 from the upper side so that a lower end portion of the support frame front wall 55 faces a front end portion of the reservoir frame bottom wall 47 from the upper side and a front peripheral part of the collection opening 34 of the support frame upper wall 52 faces an upper end portion of the partition wall 43 of the reservoir frame 40 from the upper side.

In the meantime, a lower half part (specifically, a part of the support frame sidewall 53, which is lower than the support frame upper wall 52) of the support frame sidewall 53 faces a front half part of the reservoir frame sidewall 48 of the reservoir frame 40 from an outer side in the left-right direction.

The cover frame 42 is provided at the upper of a rear half part of the reservoir frame 40 at the rear of the support frame 41. The cover frame 42 has a frame shape that has open front and lower sides and also has a substantially rectangular bottom surface, when seen from a plan view. The cover frame 42 has a cover frame upper wall 54, a pair of left and right cover frame sidewalls 49 and a cover frame rear wall 50.

The cover frame upper wall 54 is provided to an upper end portion of the cover frame 42 and has a substantially rectangular flat plate shape, when seen from a plan view.

The pair of cover frame sidewalls 49 has a substantially flat plate shape that extends downwards from both left and right end portions of the cover frame upper wall 54 and also extends in the front-rear direction, respectively.

The cover frame rear wall 50 has a substantially flat plate shape that extends downwards from a rear end portion of the cover frame upper wall 54 and also extends in the left-right direction. Both left and right end portions of the cover frame rear wall 50 continue to respective rear end portions of the pair of cover frame sidewalls 49, respectively.

The cover frame 42 covers a rear half part of the reservoir frame 40 from the upper side so that a lower end portion of the cover frame rear wall 50 faces an upper end portion of the reservoir frame rear wall 51 from the upper side and a front end portion of the cover frame upper wall 54 faces a rear end portion of the support frame upper wall 52 from the rear side.

Figure 11:
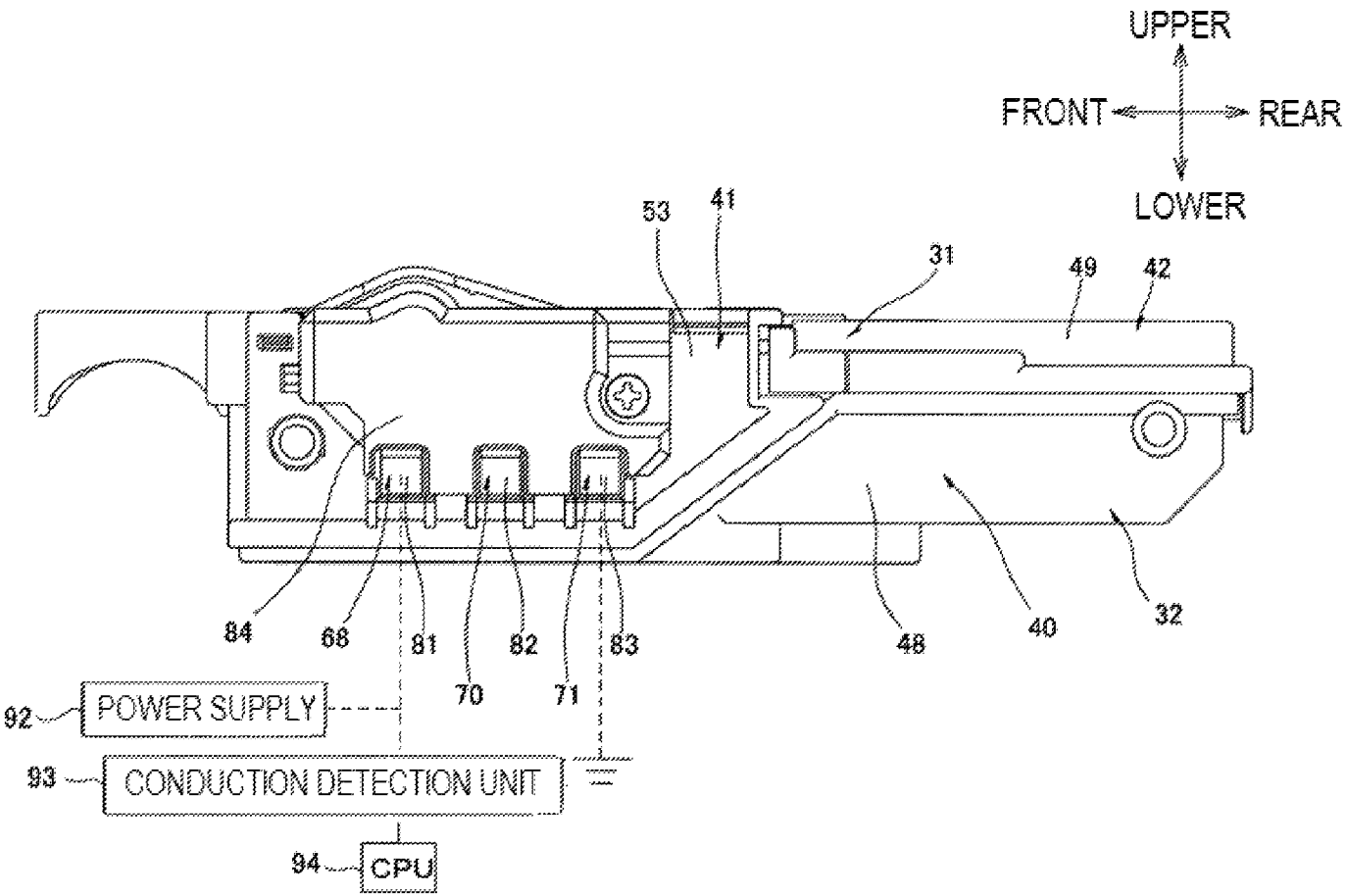
FIG. 11 is a right side view of the belt cleaning unit shown in FIG. 2.

In the meantime, lower end portions of the cover frame sidewalls 49 are arranged to face the upper end portions of the reservoir frame sidewalls 48 from the upper side (refer to FIG. 11).

Seal members 29 seal between the support frame front wall 55 and the reservoir frame bottom wall 47, between the partition wall 43 and the support frame upper wall 52, between the cover frame rear wall 50 and the reservoir frame rear wall 51, between the cover frame upper wall 54 and the support frame upper wall 52 and between the cover frame sidewalls 49 and the reservoir frame sidewalls 48.

The seal member 29 is made of an elastic material such as sponge and silicon rubber, for example.

Thereby, the accommodation housing 32 has a substantially rectangular box shape, when seen from a plan view that is flat in the upper-lower direction, and is divided into a first accommodation part 44 that is at the rear of the partition wall 43 and a second accommodation part 45 that is at the front of the partition wall 43 by the partition wall 43.

Figure 6:
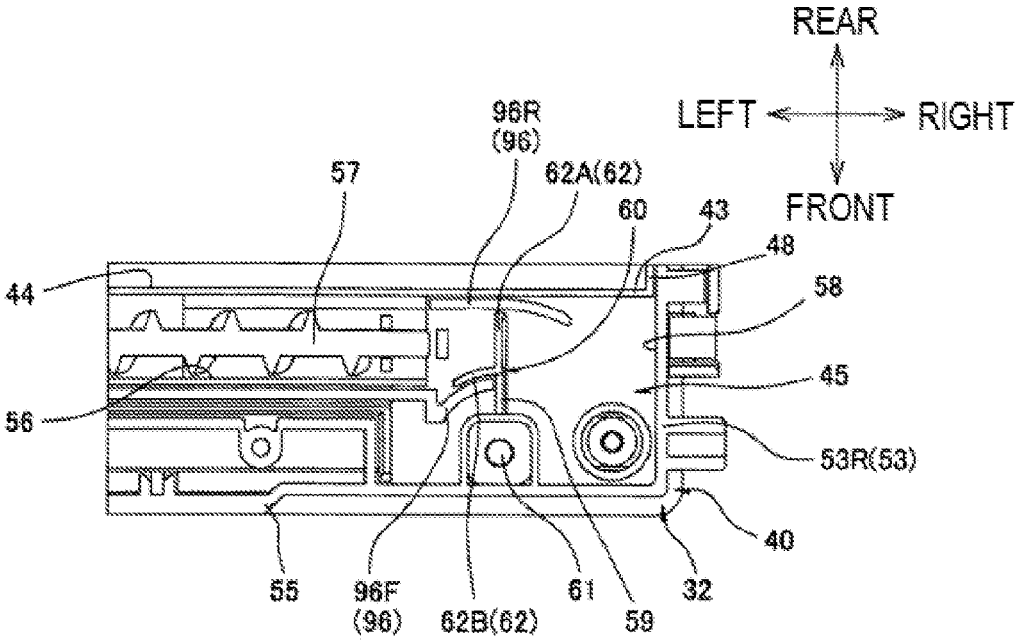
FIG. 6 is a plan sectional view of a right front end portion of the belt cleaning unit shown in FIG. 2, showing a state where a flapper is arranged at a first position.

Also, as shown in FIGS. 3, 4 and 6, the second accommodation part 45 is formed with an auger accommodation part 56 that is an example of the conveyance member accommodation part and a reservoir part 58.

The auger accommodation part 56 has a substantially cylindrical shape that extends in the left-right direction at the right of the communication hole 46. A right end portion of the auger accommodation part 56 is arranged to face the right reservoir frame sidewall 48 at an interval from the left side of the sidewall 48 and is opened towards the right side. In the auger accommodation part 56, an auger screw 57 that is an example of the conveyance member is rotatably accommodated.

The auger screw 57 has a screw shape extending in the left-right direction. An outer diameter of the auger screw 57 is substantially the same as an inner diameter of the auger accommodation part 56.

The reservoir part 58 is formed at the right of the right end portion of the auger accommodation part 56.

(2) Belt Cleaning Roller, Collection Roller and Scraping Blade

As shown in FIGS. 1 to 3, the belt cleaning roller 37 faces a backup roller 38 that is arranged in the conveyance belt 19, and is disposed at the front-upper side of the collection opening 34. The belt cleaning roller 37 has a belt cleaning roller shaft 35 and a belt cleaning roller body 36.

In the meantime, the backup roller 38 is rotatably supported between sidewalls of the body casing 2 in the conveyance belt 19 so that it contacts the belt cleaning roller 37 from the upper side of the belt cleaning roller. The backup roller 38 is made of metal and has a substantially cylindrical shape extending in the left-right direction.

The belt cleaning roller shaft 35 is made of metal and has a substantially cylindrical shape extending in the left-right direction. The belt cleaning roller shaft 35 is rotatably supported between the pair of support frame sidewalls 53 at the front-upper side of the collection opening 34.

The belt cleaning roller body 36 is made of conductive resin, has a substantially cylindrical shape extending in the left-right direction and covers the belt cleaning roller shaft 35 so that both left and right end portions of the belt cleaning roller shaft 35 are exposed.

The collection roller 33 is rotatably supported between the support frame sidewalls 53 at the upper side of the collection opening 34 so that it contacts the belt cleaning roller 37 from the rear-lower side of the belt cleaning roller. The collection roller 33 is made of metal and has a substantially cylindrical shape extending in the left-right direction.

The scraping blade 39 is disposed at the rear-lower side of the collection roller 33. The scraping blade 39 has a substantially flat plate shape that is long in the left-right direction. A rear end portion, i.e., a base end portion of the scraping blade 39 is supported to the upper of the support frame upper wall 52 at a rear peripheral part of the collection opening 34. Also, a front end portion, i.e., a free end portion of the scarping blade 39 contacts a circumferential surface of the collection roller 33 from the rear-lower side of the circumferential surface.

(3) Configuration for Power-Feeding to Belt Cleaning Roller

Figure 7:
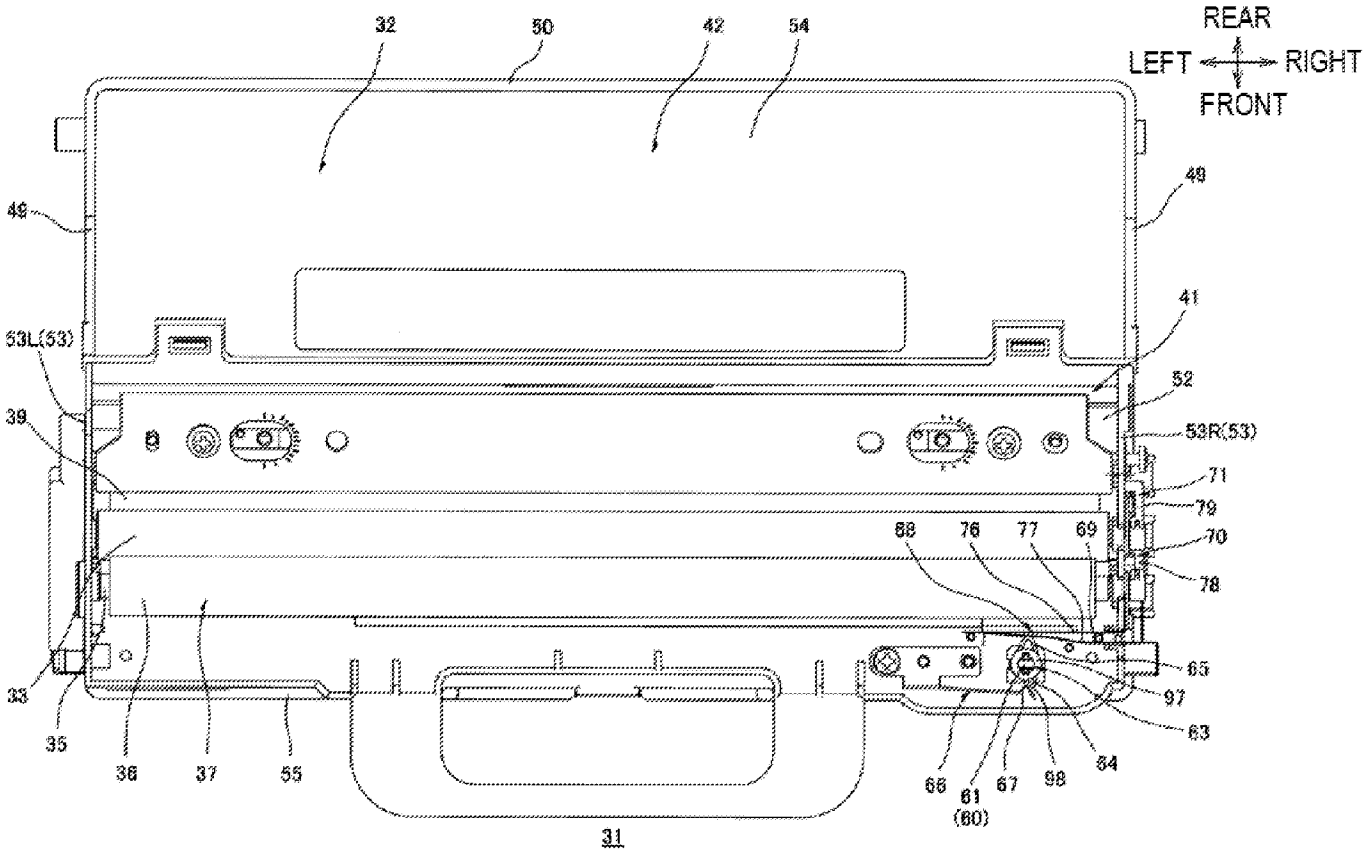
FIG. 7 is a plan view in which a switch cover of the belt cleaning unit shown in FIG. 2 is detached, showing a state where the flapper is arranged at the first position.
Figure 8:
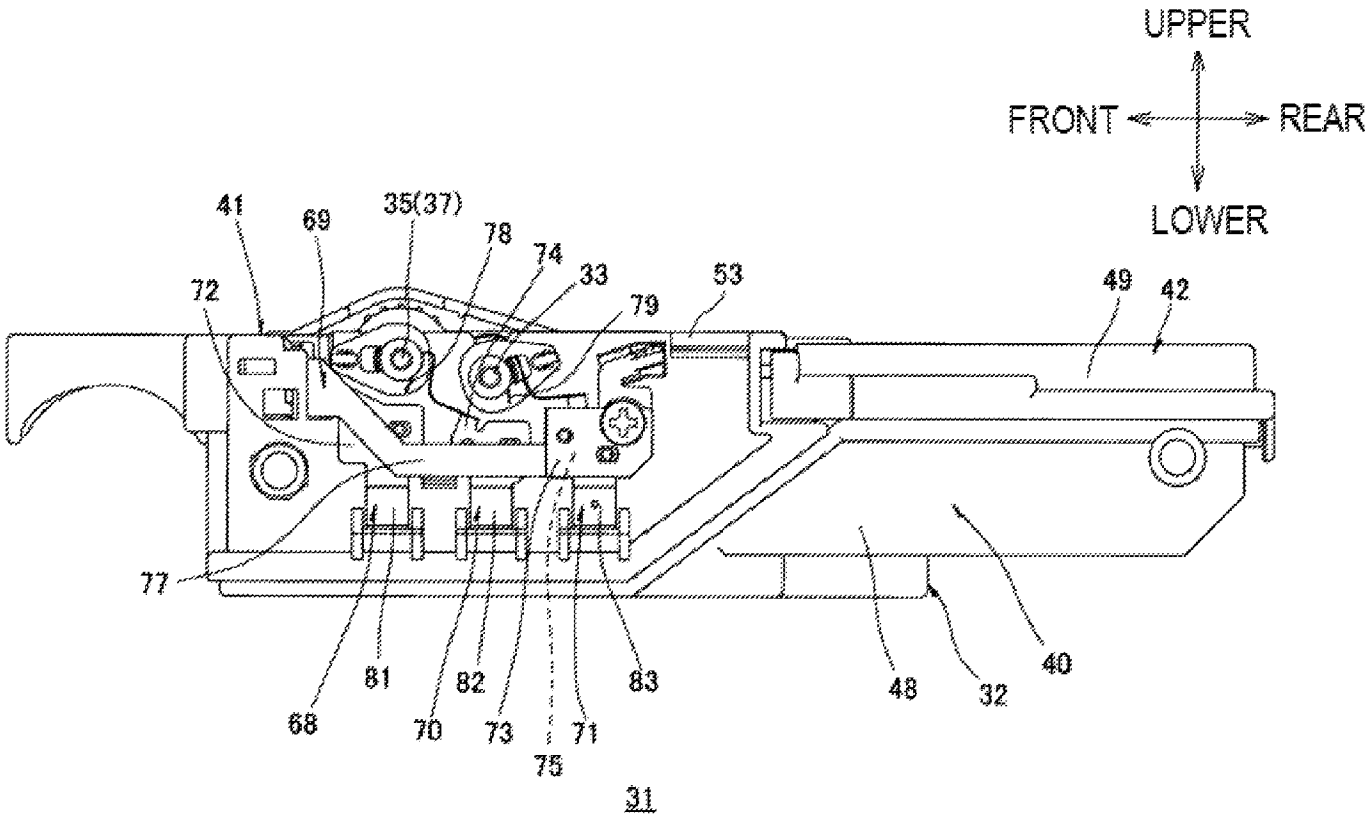
FIG. 8 is a right side view showing a state where an electrode cover of the belt cleaning unit shown in FIG. 2 is detached.

As shown in FIGS. 7 and 8, the right support frame sidewall 53R of the accommodation housing 32 is provided with a belt cleaning electrode 70 that can be electrically connected to a zener diode (not shown) of a substrate (not shown) provided in the body casing 2 so that a potential difference between the belt cleaning roller 37 and the collection roller 33 is kept constant and with a collection electrode 71 that grounds the collection roller 33.

The belt cleaning electrode 70 is made of a curved metal plate and has a main body part 74, an external contact part 82 and a roller contact part 78.

The main body part 74 is disposed at a center of the right support frame sidewall 53R in the front-rear direction at the rear-lower side of the belt cleaning roller 37. The main body part 74 has a substantially rectangular flat plate shape, when seen from a side, and is fixed to a right side surface of the right support frame sidewall 53R.

The external contact part 82 has a substantially rectangular shape, when seen from a side extending downwards from a lower end portion of the main body part 74.

The roller contact part 78 has a curved flat plate shape that extends from a front-upper end portion of the main body part 74 towards the front-upper side. Specifically, the roller contact part 78 is bent into a substantial U shape that extends rightwards from a front-upper end portion of the main body part 74, extends from a front end portion thereof towards the front-upper side and is opened downwards at a front-upper end portion thereof. The roller contact part 78 contacts the circumferential surface of the belt cleaning roller shaft 35 from the rear-lower side of the circumferential surface at the front-upper end portion of the roller contact part 78.

The collection electrode 71 is made of a curved metal plate and has a main body part 75, an external contact part 83 and a roller contact part 79.

The main body part 75 is disposed at the rear of the main body part 74 of the belt cleaning roller 70 at the rear-lower side of the collection roller 33. The main body part 75 has a substantially rectangular flat plate shape in a side view and is fixed to a right surface of the right support frame sidewall 53R.

The external contact part 83 has a substantially rectangular shape in a side view and extends downwards from a lower end portion of the main body part 75.

The roller contact part 79 has a curved flat plate shape that extends from a front-upper end portion of the main body part 75 towards the front-upper side. Specifically, the roller contact part 79 is bent into a substantial U shape that extends rightwards from a front-upper end portion of the main body part 75, extends from a front end portion thereof towards the front-upper side and is opened downwards at a front-upper end portion thereof. The roller contact part 79 contacts a right end portion of the collection roller 33 from the rear-lower side of the right end portion at the front-upper end portion of the roller contact part 79.

(4) Configuration for Detecting Whether Accommodation Housing is Full

As shown in FIG. 6, the reservoir part 58 of the accommodation housing 32 is provided therein with two guide plates 96 and a flapper 60 that is an example of the moving member.

The two guide plates 96 consist of a front side guide plate 96F that is opposed to the right side of a front-right end portion of the auger accommodation part 56 and a rear side guide plate 96R that is opposed to the right side of a rear-right end portion of the auger accommodation part 56.

The front side guide plate 96F continues to the front-right end portion of the auger accommodation part 56 and has a substantially circular plate shape, when seen from a plan view having a rotary shaft 61 (which will be described later) of the flapper 60 as a center.

The rear side guide plate 96R is arranged to face the rear-right end portion of the auger accommodation part 56 and has a substantially flat plate shape extending in the left-right direction. Specifically, a left half part of the rear side guide plate 96R is opposed to the rear of the front side guide plate 96F and has a substantially linear shape extending in the left-right direction. Also, a right half part of the rear side guide plate 96R is arranged at the right of the front side guide plate 96F and has a substantially circular shape, when seen from a plan view having the rotary shaft 61 (which will be described later) of the flapper 60 as a center.

The flapper 60 is arranged at the right of a right end portion of the front side guide plate 96F. The flapper 60 has the rotary shaft 61, an extension part 59 and an accumulation part 62.

The rotary shaft 61 is arranged at a right-front side of the front side guide plate 96F and has a substantially cylindrical shape extending in the upper-lower direction.

The extension part 59 has a substantially rod shape extending rearwards from a lower end portion of the rotary shaft 61.

The accumulation part 62 has a substantially L shape, when seen from a plan view extending upwards from a rear end portion of the extension part 59. Specifically, the accumulation part 62 integrally has a first part 62A that extends in the extending direction of the extension part 59 and a second part 62B that extends leftwards from a front end portion of the first part 62A.

The first part 62A has a substantially flat plate shape extending in the front-rear and upper-lower directions. A length of the first part 62A in the front-rear direction is substantially the same as (slightly shorter than) an interval in the front-rear direction between the right end portion of the front side guide plate 96F and the rear side guide plate 96R. Also, a length of the first part 62A in the upper-lower direction is substantially the same as an inside dimension of the reservoir part 58 in the upper-lower direction.

The second part 62B has a substantially circular plate shape having the rotary shaft 61 as a center, when seen from a plan view. A length of the second part 62B in the upper-lower direction is the same as that of the first part 62A in the upper-lower direction.

The flapper 60 is rotatably supported by the reservoir frame bottom wall 47 at a lower end portion of the rotary shaft 61 and is also rotatably supported by the support frame upper wall 52 at an upper end portion of the rotary shaft 61. In the meantime, the upper end portion of the rotary shaft 61 is disposed above the support frame upper wall 52 so that as to penetrate the support frame upper wall 52.

The flapper 60 can be rotated to a first position (refer to FIG. 6) extending rearwards and a second position (refer to FIG. 9) extending in the right-rear direction while using the rotary shaft 61 as a support point.

When the flapper 60 is arranged at the first position, the right end portion of the front side guide plate 96F and the rear side guide plate 96R are closed therebetween by the first part 62A of the accumulation part 62. In the meantime, at this time, the second part 62B of the accumulation part 62 is arranged to face the front side guide plate 96F at the rear of the front side guide plate 96F.

When the flapper 60 is arranged at the second position, the accumulation part 62 is spaced rightwards from the front side guide plate 96F and the rear side guide plate 96R.

Figure 9:
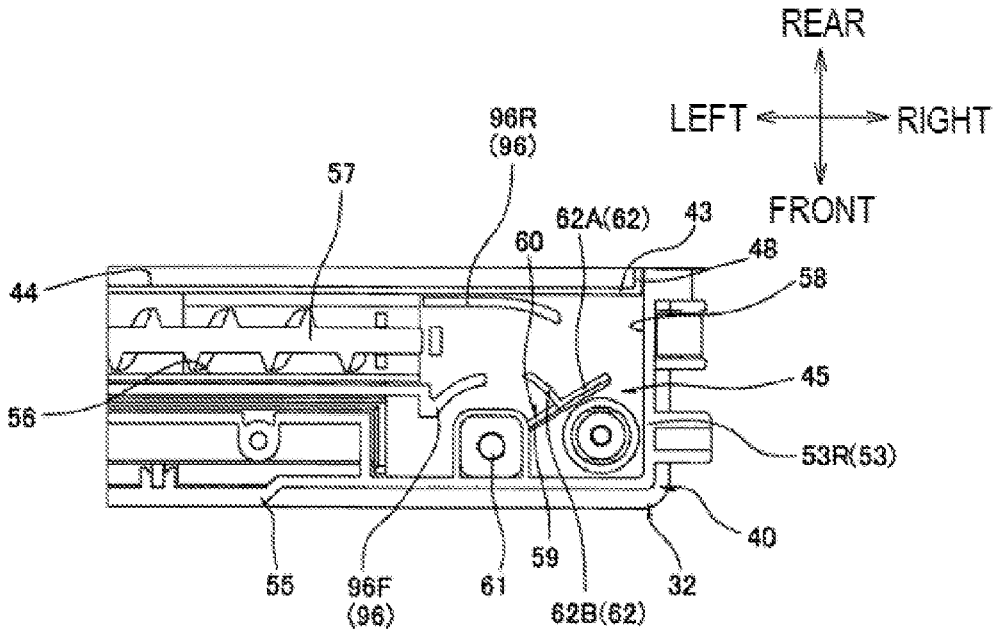
FIG. 9 is a plan sectional view of the right front end portion of the belt cleaning unit shown in FIG. 2, showing a state where the flapper is arranged at a second position.

Also, as shown in FIGS. 7 and 9, the accommodation housing 32 has a switch cam 63, a plate spring 66 that is an example of the restraining member and the abutting member, a first detection electrode 68 that is an example of the detected member and the first electrode and a second detection electrode 69 that are an example of the detected member and the second electrode.

The switch cam 63 is provided at the upper of the right end portion of the support frame upper wall 52 and integrally has a fixation part 97, an urged part 64 that is an example of the protrusion part and a pushing part 65.

The fixation part 97 has a substantially cylindrical shape extending in the upper-lower direction. An inner diameter of the fixation part 97 is substantially the same as an outer diameter of the rotary shaft 61 of the flapper 60.

The urged part 64 has a substantially triangular shape when seen in a plan view, and has a vertex portion 98 serving as an example of the protrusion end portion facing the front side so that it protrudes toward the front side from a front end portion of the fixation part 97.

The pushing part 65 has a substantially triangular shape when seen from a plan view, and has a vertex portion the rear side so that it protrudes toward the rear side from a rear end portion of the fixation part 97.

The switch cam 63 is fitted to the rotary shaft 61 of the flapper 60 at the fixation part 97 so that it cannot be relatively rotated.

The plate spring 66 is arranged at the left side of the switch cam 63. The plate spring 66 is made of a metal plate and has a substantially flat plate shape extending in the left-right direction and having a thickness in the front-rear direction. A left end portion of the plate spring 66 is fixed to an upper surface of the support frame upper wall 52 of the support frame 41. Also, a right end portion 67 of the plate spring 66 is bent into a substantially triangular shape having a vertex portion facing rearwards, when seen in a plan view.

As shown in FIGS. 7 and 8, the first detection electrode 68 is made of a bent metal plate and has a main body part 72, an external contact part 81 and a conduction part 76.

The main body part 72 is arranged at the lower side of the belt cleaning roller 37 and at the front of the main body part 74 of the belt cleaning electrode 70. The main body part 72 has a substantially rectangular flat plate shape when seen in a side view and is fixed to the right surface of the right support frame sidewall 53R.

The external contact part 81 has a substantially rectangular shape extending downwards from a lower end portion of the main body part 72, when seen from a side.

The conduction part 76 has a curved flat plate shape that extends from a front-upper end portion of the main body part 72 towards the front-upper side. Specifically, the conduction part 76 extends from a front-upper end portion of the main body part 72 towards the front-upper side, is bent leftwards at a front end portion thereof and extends leftwards. The conduction part 78 is arranged to face the switch cam 63 at an interval at the rear side of the switch cam.

The second detection electrode 69 is made of a bent metal plate and has a main body part 73 and a conduction part 77.

The main body part 73 is arranged at the front side of the main body part 74 of the belt cleaning electrode 70 so that it contacts the main body part 75 of the collection electrode 71 from the right side. The main body part 73 has a substantially rectangular flat plate shape in a side view and is fixed to the right surface of the right support frame sidewall 53R together with the main body part 75 of the collection electrode 71.

The conduction part 77 has a curved flat plate shape that extends to the front side from a front end portion of the main body part 73. Specifically, the conduction part 77 extends to the right side from a front end portion of the main body part 73, is bent to the front side at a right end portion thereof and extends to the front side so that it passes the right sides of the main body part 74 of the belt cleaning electrode 70 and the main body part 72 of the first detection electrode 68 at an interval. Also, the conduction part 77 is bent to the left side at a front end portion thereof and thus extends to the left side. A left end portion of the conduction part 77 is arranged to face the conduction part 76 of the first detection electrode 68 at the front thereof at an interval at the rear of the switch cam 63.

As shown in FIGS. 6 and 7, when the flapper 60 is arranged at the first position, the vertex portion of the pushing part 65 of the switch cam 63 is arranged to face the rear side.

At this time, the conduction part 77 of the second detection electrode 69 is pushed rear side while being abutted on the vertex portion of the pushing part 65 of the switch cam 63, is bent to the rear side against the elastic force thereof and is brought into contact with the conduction part 76 of the first detection electrode 68 from the front side of the conduction part 76. That is, the first detection electrode 68 and the second detection electrode 69 are enabled to conduct each other.

Also, at this time, the urged part 64 of the switch cam 63 abuts on the right end portion of the plate spring 66 at the left side of the vertex portion 98.

Thereby, the switch cam 63 is restrained from rotating in a clockwise direction, when seen in a plan view, because it abuts on the plate spring 66.

Figure 10:
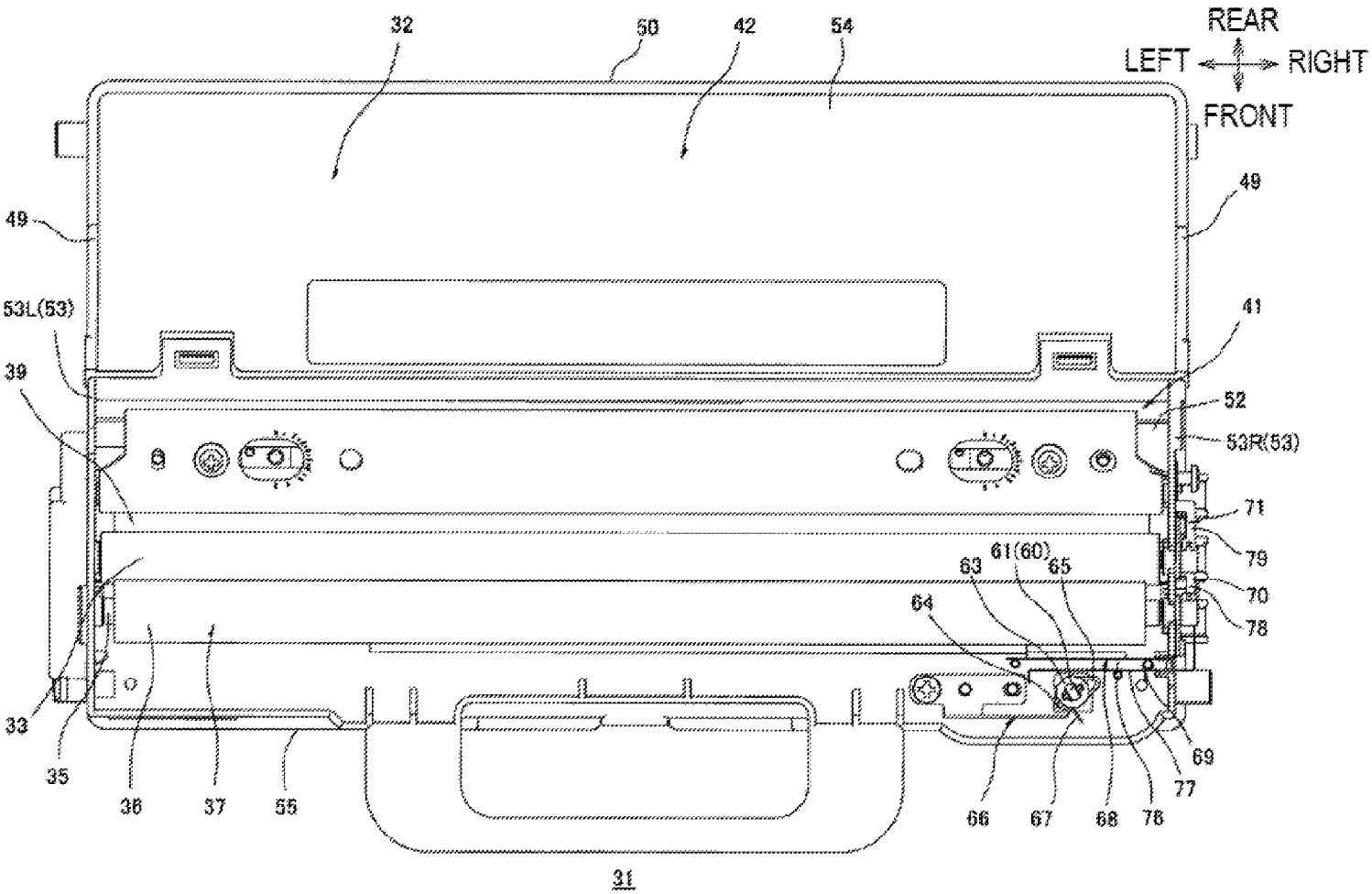
FIG. 10 is a plan view in which the switch cover of the belt cleaning unit shown in FIG. 2 is detached, showing a state where the flapper is arranged at the second position.

Also, as shown in FIGS. 9 and 10, when the flapper 60 is arranged at the second position, the vertex portion of the pushing part 65 of the switch cam 63 is spaced from the conduction part 77 of the second detection electrode 69 in the right-front direction.

Also, the conduction part 77 of the second detection electrode 69 is restored by the elastic force thereof and is arranged to face the conduction part 76 of the first detection electrode 68 at an interval at the front of the conduction part 76. That is the first detection electrode 68 and the second detection electrode 69 are not conducted.

Also, at this time, the urged part 64 of the switch cam 63 abuts on the right end portion of the plate spring 66 at the right side of the vertex portion 98.

Thereby, the switch cam 63 is restrained from rotating in a counterclockwise direction when seen in a plan view.

(5) Electrode Cover and Switch Cover

As shown in FIGS. 2 and 11, the belt cleaning unit 31 has an electrode cover 84 and a switch cover 85 that is an example of the cover.

The electrode cover 84 is provided at the right side of the accommodation housing 32 so that it exposes the external contact part 81 of the first detection electrode 68, the external contact part 82 of the belt cleaning electrode 70 and the external contact part 83 of the collection electrode 71 and covers the other parts of the first detection electrode 68, the belt cleaning electrode 70 and the collection electrode 71 and the entire second detection electrode 69.

The switch cover 85 is provided at the upper of the right front end portion of the accommodation housing 32 so that it covers the plate spring 66, the switch cam 63, the conduction part 76 of the first detection electrode 68 and the conduction part 77 of the second detection electrode 69. The switch cover 85 is provided with an exposing part 86 that exposes the fixation part 97 of the switch cam 63.

The exposing part 86 is arranged to face the fixation part 97 of the switch cam 63 at the upper of the fixation part 97 and has a substantially linear shape extending in the left-right direction.

(6) Electrical Connection Between Belt Cleaning Unit and Body Casing

As shown in FIG. 1, the external contact part 83 of the collection electrode 71 is grounded to the body casing 2.

The external contact part 81 of the first detection electrode 68 is electrically connected with a conduction detection unit 93 in the body casing 2, which is an example of the detection unit. Also, in the body casing 2, a voltage of 3.3V, for example, is applied between the external contact part 81 of the first detection electrode 68 and the conduction detection unit 93 by a power supply substrate 92.

In the body casing 2, the conduction detection unit 93 is electrically connected to the power supply substrate 92 and is electrically connected to a CPU 94 that is an example of the determination unit.

3. Printing Operations of Printer

When image data that is transmitted from a PC and the like at the outside is received, the above image forming operation starts.

Here, a bias of +1,400V is applied to the backup roller 38 from a power supply (not shown).

Also, the belt cleaning roller shaft 35 is applied with a bias in which a potential difference between the belt cleaning roller 37 and the collection roller 33 is +400V by the power supply substrate 92 of the body casing 2 and a circuit configuration enabling the potential difference between the belt cleaning roller 37 and the collection roller 33 to be constant.

During the image forming operation, when the toner image carried on the photosensitive drum 8 is transferred to the sheet P, paper dust (which is an example of the adhering substance) of the sheet P may be adhered to the surface of the conveyance belt 19.

The paper dust adhered on the surface of the conveyance belt 19 is opposed to the belt cleaning roller 37 as the conveyance belt 19 circulates. Then, the paper dust is electrostatically held on the circumferential surface of the belt cleaning roller 37 by the belt cleaning bias.

The paper dust held on the circumferential surface of the belt cleaning roller 37 is opposed to the collection roller 33 as the belt cleaning roller 37 rotates, and is then electrostatically held on the circumferential surface of the collection roller 33. After that, the paper dust electrostatically held on the circumferential surface of the collection roller 33 is physically scraped by the scraping blade 39. The scraped paper dust is dropped and reserved into the first accommodation part 44 of the belt cleaning unit 31.

4. Operation of Collecting Transfer Residual Toner from Drum Cleaning Rollers In the printer, when the image forming operation is over, a cleaning operation of collecting the transfer residual toner held on the drum cleaning rollers 30 into the belt cleaning unit 31 starts.

In the cleaning operation, the transfer residual toner held on the drum cleaning rollers 30 is discharged to the circumferential surfaces of the photosensitive drums 8.

The transfer residual toner discharged to the circumferential surfaces of the photosensitive drums 8 is opposed to the conveyance belt 19 as the photosensitive drums 8 rotate.

Then, the transfer residual toner on the surfaces of the photosensitive drums 8 is transferred to the surface of the conveyance belt 19 by the transfer bias of the transfer rollers 20.

After that, the transfer residual toner (which is an example of the adhering substance) transferred to the surface of the conveyance belt 19 is opposed to the belt cleaning roller 37 as the conveyance belt 19 circulates.

Then, like the paper dust, the transfer residual toner is electrostatically held on the circumferential surface of the belt cleaning roller 37 by the belt cleaning bias, is electrostatically displaced to the collection roller 33, is scraped by the scraping blade 39 and is thus dropped into the first accommodation part 44 through the collection opening 34 of the belt cleaning unit 31.

The transfer residual toner dropped into the first accommodation part 44 is conveyed rearwards by a conveyance unit (not shown).

By doing so, the cleaning operation is completed.

5. Operation of Detecting Whether Belt Cleaning Unit is Full

As shown in FIG. 6, when the first accommodation part 44 of the belt cleaning unit 31 is not full, the flapper 60 is arranged at the first position.

At this time, as described above and as shown in FIG. 7, the conduction part 77 of the second detection electrode 69 contacts the conduction part 76 of the first detection electrode 68 from the front of the conduction part 76.

That is, a circuit that is grounded via the first detection electrode 68, the second detection electrode 69 and the collection electrode 71 sequentially from the power supply substrate 92 is formed, and the conduction detection unit 93 detects current corresponding to 0V.

Then, the CPU 94 determines that the flapper 60 is arranged at the first position, based on the current detection of the conduction detection unit 93, and determines that the first accommodation part 44 of the belt cleaning unit 31 is not full.

When the adhering substance such as paper dust and transfer residual toner to be reserved is increased in the first accommodation part 44, the adhering substance is gradually reserved in the front end portion of the first accommodation part 44.

When the adhering substance is further collected from a state where the first accommodation part 44 is full of the adhering substance, the adhering substance in the first accommodation part 44 is supplied from the first accommodation part 44 to the left end portion of the auger accommodation part 56 of the second accommodation part 45 through the communication hole 46.

Then, the adhering substance supplied to the auger accommodation part 56 is conveyed rightwards by the auger screw 57.

As shown in FIG. 6, the conveyed adhering substance is accumulated in a space that is defined by the two guide plates 96 and the accumulation part 62 of the flapper 60.

When an amount of the adhering substance accumulated in the space that is defined by the two guide plates 96 and the accumulation part 62 of the flapper 60 is increased, the accumulation part 62 of the flapper 60 is pushed to the right side by the adhering substance conveyed by the auger screw 57.

Then, the flapper 60 is rotated in the clockwise direction, when seen in a plan view, against the urging force of the plate spring 66. Also, as the flapper 60 is rotated, the switch cam 63 is rotated in the clockwise direction, when seen in a plan view.

At this time, the urged part 64 of the switch cam 63 presses the right end portion 67 of the plate spring 66 in the left direction.

Then, the plate spring 66 is elastically deformed forwards so that the right end portion 67 gets on the front side of the urged part 64.

Then, when the adhering substance is further accumulated in the accumulation part 62 of the flapper 60, the flapper 60 is further rotated.

Thereby, the switch cam 63 is rotated so that the vertex portion 98 of the urged part 64 passes between the vertex portion of the right end portion 67 of the plate spring 66 and the fixation part 97 of the switch cam 63 from the right side to the left side.

When the vertex portion 98 of the urged part 64 of the switch cam 63 is arranged at the left of the vertex portion of the right end portion 67 of the plate spring 66, the vertex portion of the right end portion of the plate spring 66 abuts on the urged part 64 of the switch cam 63 at the right side of the vertex portion 98.

Then, the plate spring 66 is restored to the rear side by the elastic force thereof and urges the urged part 64 of the switch cam 63 in the clockwise direction, when seen in a plan view.

Thereby, the switch cam 63 is rotated in the clockwise direction, when seen in a plan view, by the urging force of the plate spring 66. Also, as the switch cam 63 is rotated, the flapper 60 is rotated in the clockwise direction, when in from a plan view.

Then, the plate spring 66 is restored to its original state, and when the rotation of the switch cam 63 is over, the flapper 60 is arranged at the second position.

When the flapper 60 is arranged at the second position, the conduction part 77 of the second detection electrode 69 is restored by the elastic force thereof and is thus arranged to face the conduction part 76 of the first detection electrode 68 at an interval at the front of the conduction part 76, as described above and as shown in FIGS. 9 and 10.

Then, the first detection electrode 68 and the second detection electrode 69 becomes unconducted and the conduction detection unit 93 detects the current corresponding to 3.3V from the power supply substrate 92.

Thereby, based on the variation in the current value of the conduction detection unit 93, the CPU 94 determines that the flapper 60 is arranged at the second position and thus determines that the first accommodation part 44 of the belt cleaning unit 31 is full.

After that, the CPU 94 displays a notification, which indicates the belt cleaning unit 31 should be replaced, on an operation panel (not shown) and the like.

7. Operational Effects (1) According to the belt cleaning unit 31 and the printer 1, as shown in FIGS. 6 and 7, when the accommodation housing 32 can accommodate therein the adhering substance (paper dust, transfer residual toner), the flapper 60 is arranged at the first position and is restrained from moving from the first position to the second position by the plate spring 66.

Then, as shown in FIGS. 9 and 10, when the accommodation housing 32 is full of the adhering substance, the flapper 60 is moved from the first position to the second position against the urging force of the plate spring 66 and is then restrained from moving from the second position to the first position by the plate spring 66.

At this time, the conduction detection unit 93 in the body casing 2 detects the moving of the flapper 60 from the first position to the second position, and the CPU 94 in the body casing 2 determines that the accommodation housing 32 is full, based on the detection.

Thereby, when the accommodation housing 32 can accommodate therein the adhering substance, it is possible to surely detect that the accommodation housing 32 can accommodate therein the adhering substance because the flapper 60 is restrained at the first position.

Also, after the accommodation housing 32 is full of the adhering substance and the flapper 60 is thus moved to the second position, it is possible to surely detect that the accommodation housing 32 is full of the adhering substance because the flapper 60 is restrained at the second position.

As a result, it is possible to stably detect that the accommodation housing 32 is full of the adhering substance.

(2) Also, according to the belt cleaning unit 31 and the printer 1, as shown in FIGS. 6 and 7, when the accommodation housing 32 can accommodate therein the adhering substance, the flapper 60 is restrained at the first position by the urging force of the plate spring 66.

Also, as shown in FIGS. 9 and 10, when the first accommodation part 44 of the accommodation housing 32 is full of the adhering substance, the accumulation part 62 of the flapper 60 is pressed rightwards by the adhering substance that is conveyed by the auger screw 57. Thereby, the flapper 60 is rotated against the urging force of the plate spring 66, together with the switch cam 63.

At this time, the right end portion 67 of the plate spring 66 is pressed by the vertex portion 98 of the urged part 64 and is thus elastically deformed forwards so that it gets over the vertex portion 98 of the urged part 64.

That is, the flapper 60 is not arranged at the second position unless it is pressed from the first position to the second position with the pressing force deforming the plate spring 66 so that the right end portion 67 can get over the vertex portion 98 of the urged part 64.

Thereby, it is possible to set the pressing force for moving the flapper 60 from the first position to the second position to be constant by a simple configuration.

Therefore, when the accommodation housing 32 can accommodate therein the adhering substance, it is possible to surely restrain the flapper 60 at the first position, and when the accommodation housing 32 is full of the adhering substance, it is possible to surely move the flapper 60 from the first position to the second position and to thus restrain the same at the second position.

As a result, it is possible to stably detect that the accommodation housing 32 is full of the adhering substance with the simple configuration.

(3) Also, according to the belt cleaning unit 31 and the printer 1, as shown in FIGS. 6 and 9, the adhering substance is conveyed by the auger screw 57 and the flapper 60 can be moved from the first position to the second position by the pressing force from the adhering substance that is conveyed by the auger screw 57.

(4) Also, according to the belt cleaning unit 31 and the printer 1, as shown in FIGS. 6 and 9, it is possible to accumulate the adhering substance in the accumulation part 62 of the flapper 60 and to surely transfer the pressing force from the adhering substance that is conveyed by the auger screw 57 to the flapper 60.

Therefore, it is possible to surely move the flapper 60.

(5) Also, according to the belt cleaning unit 31 and the printer 1, as shown in FIG. 2, it is possible to surely convey the adhering substance by arranging the auger screw 57 and the auger accommodation part 56 without a gap.

Hence, it is possible to stably enable the adhering substance, which is conveyed by the auger screw 57, to act on the flapper 60.

(6) Also, according to the belt cleaning unit 31 and the printer 1, as shown in FIG. 9, after the flapper 60 is moved to the second position, the adhering substance is reserved in the reservoir part 58.

Therefore, it is possible to suppress the pressing force originating from the adhering substance, which is conveyed by the auger screw 57, from being again applied to the flapper 60 after the flapper 60 is moved to the second position.

As a result, it is possible to prevent the flapper 60 from being damaged.

(7) Also, according to the belt cleaning unit 31 and the printer 1, as shown in FIG. 2, it is possible to check a position of the flapper 60 through the exposing part 86 of the switch cover 85.

Therefore, it is possible to easily confirm whether the accommodation housing 32 of the belt cleaning unit 31 is full of the adhering substance.

(8) Also, according to the belt cleaning unit 31 and the printer 1, as shown in FIG. 11, when the accommodation housing 32 can accommodate therein the adhering substance, it is possible to electrically connect the collection roller 33 and the conduction detection unit 93 of the printer 1.

Also, when the accommodation housing 32 is full of the adhering substance, it is possible to separate the second detection electrode 69 from the first detection electrode 68 as the flapper 60 is moved from the first position to the second position, thereby electrically disconnecting the collection roller 33 and the conduction detection unit 93 of the printer 1.

Therefore, it is possible to surely detect that the accommodation housing 32 is full of the adhering substance.

(9) Also, according to the belt cleaning unit 31 and the printer 1, as shown in FIG. 10, it is possible to detect that the accommodation housing 32 is full of the adhering substance with a simple configuration of disconnecting the first detection electrode 68 and the second detection electrode 69.

While the present invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A collection device configured to collect toner from an image carrier configured to carry a developer image thereon, the collection device comprising:

an accommodation part configured to accommodate therein the collected toner;

a detection part configured to detect an amount of the collected toner in the accommodation part; and an auger screw disposed in the accommodation part and configured to rotate about an axis extending in a first direction and to convey the collected toner in the first direction toward the detection part, wherein the detection part includes:

a moving portion disposed at a downstream end portion of the accommodating part in the first direction and configured to receive a pressing force caused by the collected toner conveyed in the first direction by the auger screw and to move from a first position to a second position that is different from the first position;

an elastic portion configured to restrain the moving portion from moving from the first position to the second position when the moving portion is arranged at the first position such that the moving portion does not move from the first position to the second position when the pressing force caused by the conveyed collected toner does not exceed a predetermined pressure and such that the moving portion moves from the first position to the second position when the pressing force caused by the conveyed collected toner exceeds the predetermined pressure; and a detection member configured to detect whether or not the moving portion is in the second position.

2. The collection device according to claim 1, wherein the elastic portion is further configured to restrain the moving portion from moving from the second position to the first position when the moving portion is arranged at the second position.

3. The collection device according to claim 1, wherein the elastic portion includes a spring.

4. The collection device according to claim 1, wherein the moving portion and the elastic portion are separate members.

5. The collection device according to claim 1, wherein the moving portion is configured to pivot from the first position to the second position.

6. The collection device according to claim 5, wherein the moving portion is configured to pivot about an axis extending in a second direction perpendicular to the first direction.

7. The collection device according to claim 1, wherein the detection member include an electrode.

* * * * *